US008245637B2

(12) United States Patent
Trilk

(10) Patent No.: US 8,245,637 B2
(45) Date of Patent: Aug. 21, 2012

(54) METHOD AND DEVICE FOR SEPARATING PRINTING PLATES

(75) Inventor: Axel Trilk, Kiel (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 601 days.

(21) Appl. No.: 12/463,442

(22) Filed: May 11, 2009

(65) Prior Publication Data

US 2009/0293749 A1 Dec. 3, 2009

(30) Foreign Application Priority Data

May 27, 2008 (DE) ..... 10 2008 025 284

(51) Int. Cl.
*B41F 27/12* (2006.01)

(52) U.S. Cl. ..... 101/477; 101/483; 271/10.09; 271/10.14

(58) Field of Classification Search ..... 101/477, 101/479, 480, 483; 271/10.09, 10.14, 11, 271/12, 14, 18, 34, 37, 93, 104
See application file for complete search history.

(56) References Cited

U.S. PATENT DOCUMENTS 4,516,762 A * 5/1985 Moltrasio et al. ..... 271/11
4,815,723 A * 3/1989 Iizuka ..... 271/14
4,958,824 A * 9/1990 Willits et al. ..... 271/11
5,785,309 A * 7/1998 Halup et al. ..... 271/11
6,675,712 B2 * 1/2004 Marincic et al. ..... 101/477
6,779,793 B2 8/2004 Behrens et al.
7,458,569 B2 * 12/2008 Niggemann et al. ..... 271/10.01

FOREIGN PATENT DOCUMENTS

DE 1197903 B 8/1965
DE 19943394 A1 8/2000
DE 10134151 A1 1/2003
GB 2341384 A 3/2000

OTHER PUBLICATIONS

German Search Report dated Oct. 22, 2008.

* cited by examiner

*Primary Examiner* — Ren Yan

(74) *Attorney, Agent, or Firm* — Laurence A. Greenberg; Werner H. Stemer; Ralph E. Locher

(57) ABSTRACT

A device and a method for separating printing plates from a stack uses a lifting device for lifting the printing plates and at least one separating element to be moved under the lifted printing plates. The structurally simple device is able to react flexibly to different printing plate formats and, at the same time, avoids damage to a surface to be imaged of the individual printing plates. In order to avoid such problems, the device includes at least three separating elements which, as they move under a lifted printing plate at any time, are continuously disposed at distances from one another having a ratio that always remains constant.

15 Claims, 4 Drawing Sheets

METHOD AND DEVICE FOR SEPARATING PRINTING PLATES

CROSS-REFERENCE TO RELATED APPLICATION

This application claims the priority, under 35 U.S.C. §119, of German Patent Application DE 10 2008 025 284.0, filed May 27, 2008; the prior application is herewith incorporated by reference in its entirety.

BACKGROUND OF THE INVENTION

Field of the Invention

The invention relates to a device for separating printing forms disposed in a stack, including a lifting device for lifting a printing form off the stack and at least one separating element that can be moved under the lifted printing form. Furthermore, the invention also relates to a method for separating printing forms disposed in a stack, in which a printing form is lifted and at least one movable separating element is moved under the lifted printing form, preferably by using the device according to the invention.

In order to use printing forms in a printing process for printing material within a press, printing plates used as printing forms are generally clamped on plate cylinders belonging to the press. The printing plates must be imaged in advance in accordance with image information. In order to image the printing plates, further printing forms, such as exposed films, can be used, with their information being transferred to the printing plates, or the printing plates are themselves imaged in accordance with the image information in a so-called plate exposer.

In order to process a printing form, they are supplied from a stack, in automatic or semiautomatic methods, to a separating device for the printing forms which, in the case of printing plates, removes the uppermost printing plate from the plate stack and feeds that printing plate to a printing plate exposer to be exposed. That removal of the uppermost printing plate can be carried out manually or by an automatic loading device (loader). Such a loader is then connected or docked upstream of a printing plate exposer. A stack of printing plates to be exposed is put into the loading device through the use of a cartridge or a tray and, through a separating device belonging to the loading device, so that a printing plate can then be separated automatically and transferred to the printing plate exposer.

However, the problem with such a separation of printing plates is that printing plates resting one above another can stick to one another, the printing plates themselves can stick to intermediate layers and/or, in regions in which they are not lifted, the printing plates, which are lifted by an appropriate lifting device in order to be separated, are pulled along touching the printing plates lying underneath. The problem of the lifted printing plates being dragged along on the printing plates lying underneath in the case of a horizontal movement, occurs in particular in large-format printing plates and, in the process, can damage the side to be exposed of the printing plate lying underneath.

In order to separate such printing plates from printing plate stacks, German Patent DE 101 34 151 B4, corresponding to U.S. Pat. No. 6,779,793, discloses moving a separating element in the form of a louver or Jalousie device similar to a Venetian blind under the lifted printing plates. It is possible for the blind to separate the lifted printing plate completely from the printing plate stack, hold it firmly through a suction air stream and transport it away.

Those devices known from the prior art are firstly quite complicated structurally and, in terms of their mode of action, cannot be adapted to printing forms of different formats but must always be matched to the largest possible printing form format.

SUMMARY OF THE INVENTION

It is accordingly an object of the invention to provide a method and a device for separating printing plates, which overcome or at least help to reduce the hereinafore-mentioned disadvantages and problems of the heretofore-known methods and devices of this general type and which are structurally simple.

With the foregoing and other objects in view there is provided, in accordance with the invention, a device for separating printing forms disposed in a stack. The device comprises a lifting device for lifting a printing form off the stack, and at least two separating elements configured to be moved under the lifted printing form by displacements of the separating elements. The displacements have a substantially constant ratio in relation to one another. Preferably, the device is constructed in such a way that the separating elements are moved substantially simultaneously.

In accordance with another feature of the invention, at least three separating elements are used and these separating elements are to be moved by displacements in such a way that the separating elements are disposed at distances from one another having a ratio which always remains substantially constant.

The separating elements are constructed in such a way that they can be moved under an at least partly lifted printing form, preferably a printing plate, and they substantially completely separate regions of this printing form which are still lying on the surface located underneath from this surface. This surface can in particular be a further printing form or a printing plate belonging to a plate stack.

In accordance with a further feature of the invention, the distances between the separating elements is variable and the ratio of the distances from one another is always substantially constant, preferably 1:1. In this way, separating elements having a small distance from one another can be used in order to separate printing forms of a small format, and separating elements having a large distance from one another can be used to separate larger printing forms. Greater flexibility of the separating device having the separating elements is achieved by design through the use of the variability of the separating element distances.

In accordance with an added feature of the invention, the separating elements are bearers which include rotatable rods that are connected through contact elements to at least one drive. The at least one drive is configured in such a way that a first bearer is driven forward by a first displacement, a second bearer is driven forward by a second displacement, and a third bearer is driven forward by a third displacement under the printing form and the individual displacements always have a predefined ratio in relation to one another, preferably of 3 to 2 to 1, that is to say for a large printing plate a first bearer has to advance by a relatively small displacement, while a second bearer has to advance by a greater displacement and a third bearer by the greatest displacement. The fact that the distances between the displacements covered always remain the same also results in displacements having predefined relationships to one another. In this way, greater flexibility of the device is achieved.

In accordance with an additional feature of the invention, the contact elements are belts which connect the rods to the at least one drive. For this purpose, the at least one drive should have pulleys to drive the belts and the pulleys themselves should have different radii in the predefined ratio of the displacements to be driven forward, preferably 1:2:3. Through the use of this simple structure, with the belts and pulleys having the predefined ratio between the radii, a positive structural condition is predefined in a simple way, in each case imposing constant distances of the separating elements from one another and forcing a predefined ratio for the displacements driven forward on the basis of the different radii. In particular, through the use of the pulleys with different radii, the ratio of the displacements driven forward in relation to one another can be varied in a simple way.

In accordance with yet another feature of the invention, the printing forms are printing plates, which are gripped through the use of suction elements as lifting devices and can be lifted horizontally. In one development, the suction elements are to be formed in such a way that the lifted printing plates can be lifted, held and moved horizontally thereby, while the separating elements, which have been moved under the printing plate, together with the printing plate, can be moved in the horizontal direction such that they are able to run without contact over printing plates lying underneath in grooves for running wheels of the separating elements. During these movements in the horizontal direction to move the printing plates away from the stack, provision is made for the distances of the separating elements from one another to become smaller in each case, although the respective distance ratio remains constant.

In this way, a simple device can be devised by design which will avoid damaging printing plates that lie underneath the lifted printing plates, in that the separating elements and therefore the printing plate are moved away without contact over or alternatively rotating on the uppermost printing plate of the stack.

With the objects of the invention in view, there is also provided a method for separating printing forms disposed in a stack. The method comprises lifting a printing form, moving at least first and second separating elements under the lifted printing form, by moving the first separating element through a first displacement W1 and moving the second separating element through a second displacement W2, and providing the displacements in a substantially constant ratio relative to one another.

Therefore, the ratio of the displacements in relation to one another remains substantially constant, irrespective of their size. In this case, it is always to be assumed that the separating elements are moved under the lifted printing form by possible displacements that are different from one another. The respective displacements to be covered in this case depend in particular on the format of the corresponding printing form.

In accordance with another mode of the invention, at least three separating elements to be used and to be moved by displacements such that the ratio of these displacements is advantageously 1:2:3. In particular, provision is made for the separating elements to be moved simultaneously, which results in particular in the uniform movement of the separating elements, in particular in relation to their entirety.

In accordance with a further mode of the invention, in order to be able to separate printing forms of different formats in a straightforward manner, provision is advantageously made for the separating elements in each case to be moved underneath the printing form by a predefined maximum displacement, depending on the format of the printing forms. A smaller maximum displacement is therefore provided for smaller printing forms than for larger printing forms. This automatically advantageously in each case necessitates a smaller distance between the separating elements for the smaller formats than for the larger after the displacement has been covered.

In accordance with an added mode of the invention, in order to avoid damage to printing forms which lie underneath the separating printing form, provision is also made in this case for the horizontal movement of the separating printing form to be carried out without contact over the printing forms of the stack lying underneath, through the use of a uniform movement of the separating elements with the printing form.

In accordance with a concomitant mode of the invention, in order to ensure a constant ratio of the displacements covered by the individual separating elements in relation to one another, provision is made for the separating elements to be driven through the use of a gear mechanism having a predefined step-up ratio. The step-up ratio should advantageously be 1:2:3, so that, irrespective of the size of the printing form, stable mounting and guidance of the printing form on the separating elements is always made possible.

Other features which are considered as characteristic for the invention are set forth in the appended claims.

Although the invention is illustrated and described herein as embodied in a method and a device for separating printing plates, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
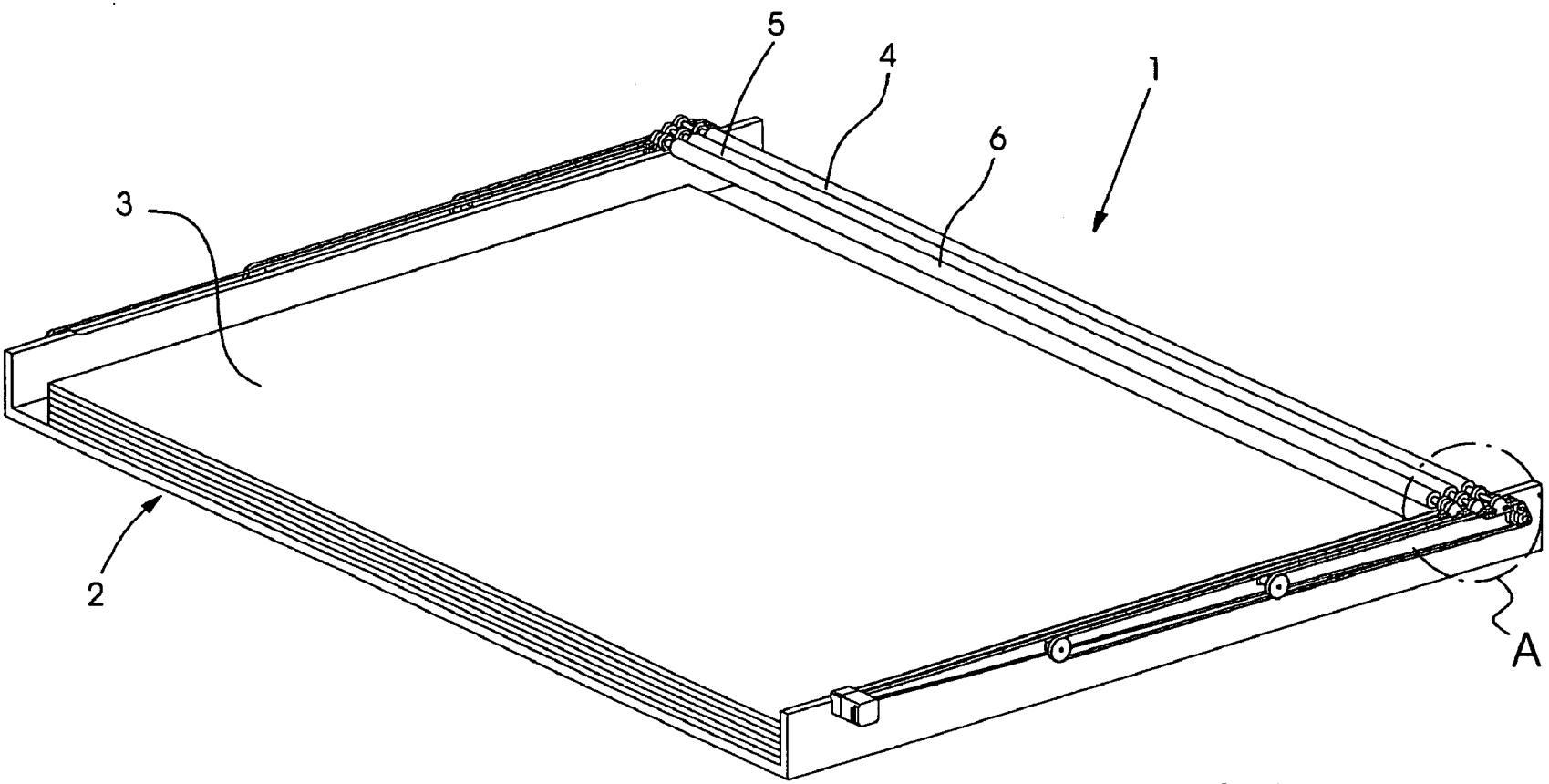
FIG. 1 is a diagrammatic, perspective view of a separating device having separating elements.

Referring now in detail to the figures of the drawings, in which a preferred exemplary embodiment of the invention is illustrated, but to which the invention is not restricted and from which further inventive features can also emerge, and first, particularly, to FIG. 1 thereof, there is seen a separating device 1, to which printing plates 3 in the form of a stack are fed through a printing plate tray 2.

The separating device 1 has bearers 4, 5, 6, which are disposed behind one another in one plane. The plane of the bearers 4, 5, 6 is located above the printing plates 3 on a printing plate tray 2.

Figure 2:
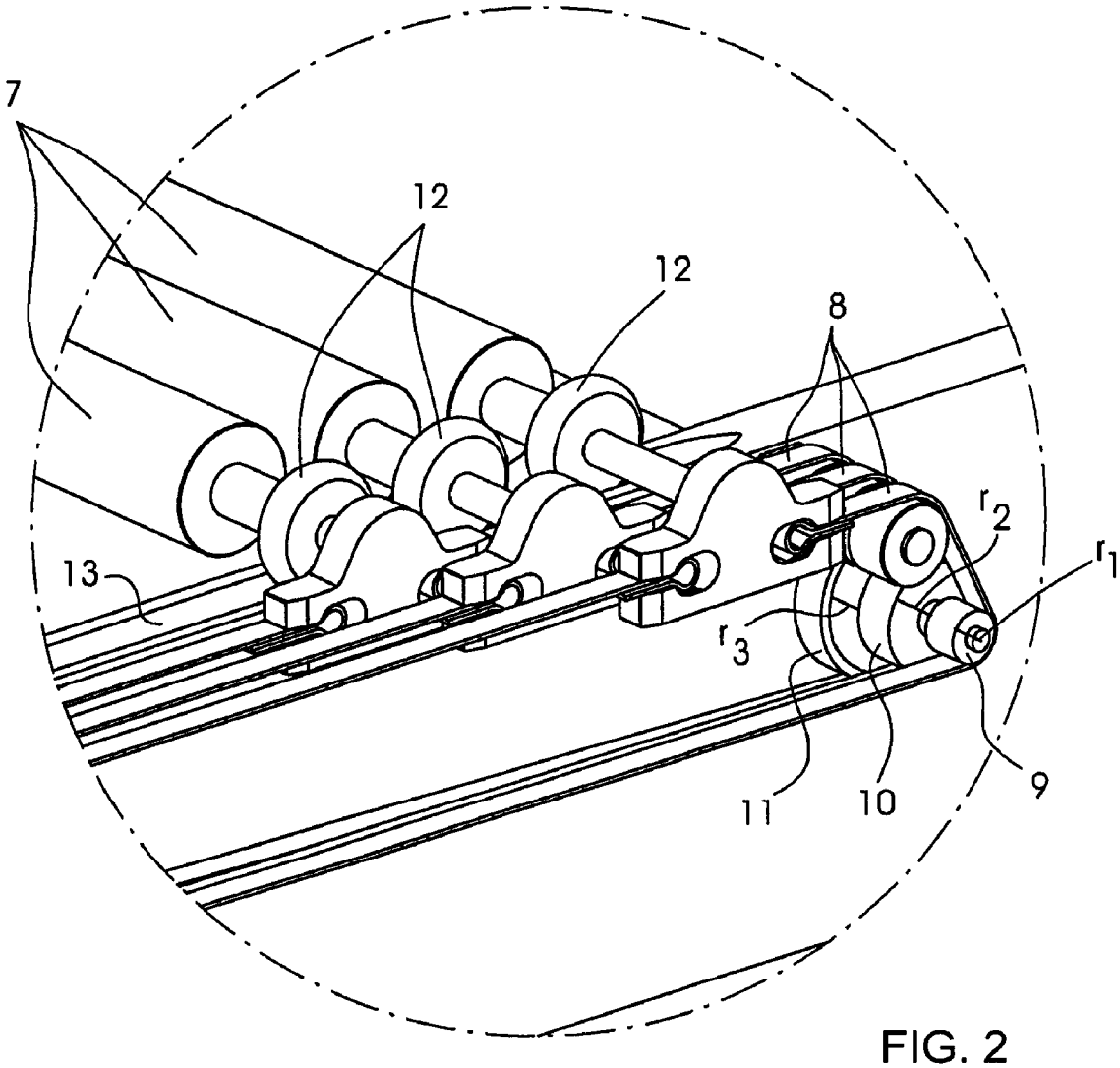
FIG. 2 is a fragmentary, perspective view of a portion A of FIG. 1, showing a drive of the separating elements.

A drive or gear mechanism 9, 10, 11 for the bearers 4, 5, 6 is located in the region of the portion A of FIG. 1. The portion A of FIG. 1 is illustrated in more detail in FIG. 2.

The bearers 4, 5, 6 are disposed behind one another and are driven by belts 8. For this purpose, the belts 8 are disposed beside one another in the same plane of movement of the bearers 4, 5, 6. The bearers 4, 5, 6 include rotatable rods 7 to be moved under a lifted printing plate 3. In the example illustrated herein, three bearers 4, 5, 6 having rods 7 are shown. A front bearer 6 is connected through a belt 8 to a first or large pulley 11 for driving the belt 8. A central bearer 5 is connected to a medium pulley 10, and a rear bearer 4 is connected to a small pulley 9. In general terms, the use of more than three bearers 4, 5, 6 is possible.

The pulleys 9, 10, 11 have radii $r_1$, $r_2$ and $r_3$. The ratio of the radii $r_1$, $r_2$ and $r_3$ in relation to one another is 1:2:3.

Figure 3:
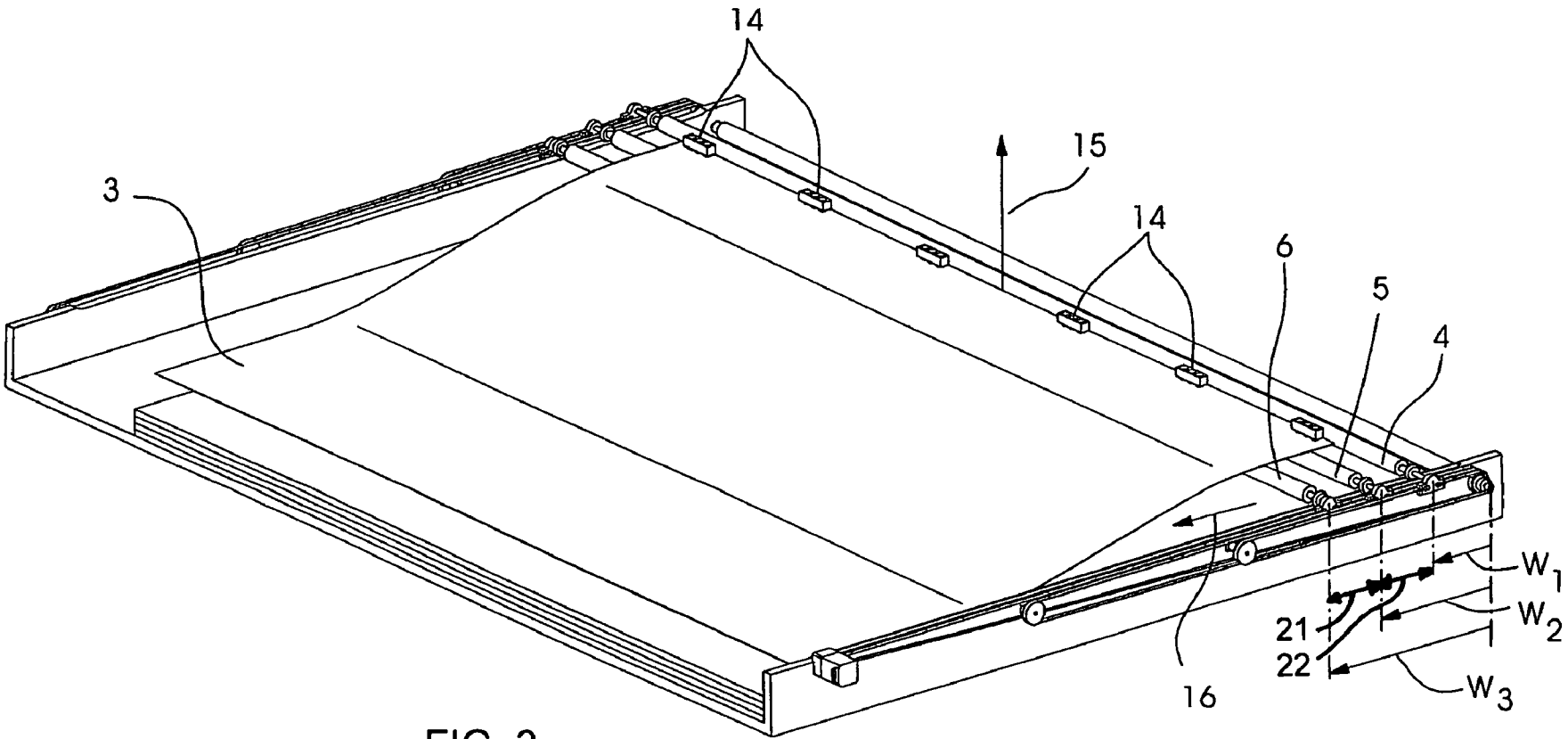
FIG. 3 is a perspective view of a lifted printing plate with separating elements pushed partly underneath.

If the pulley 9 having the small radius $r_1$ is rotated by a predefined number of revolutions, then the associated belt 8 with the bearer 4 connected thereto is moved by a first displacement, stroke or travel $W_1$ shown in FIG. 3 The pulleys 9, 10, 11 are firmly connected to one another. Given the predefined number of revolutions of the pulley 9, the pulley 10 connected thereto also rotates by the same amount. As a result of the larger radius $r_2$, which is twice as large as the radius $r_1$, the associated central bearer 5 also travels over a displacement $W_2$ that is twice as large. The same is true for the front bearer 6, which is connected to the pulley 11 that is three times as large and which therefore is moved over a displacement $W_3$ that is three times as large as the small displacement $W_1$ of the bearer 4.

In order to ensure that the bearers 4, 5, 6 can be moved without contact above the stack of printing plates 3, the bearers 4, 5, 6 are each connected to a respective running wheel 12 in such a way that the running wheels 12 run within respective grooves 13 and the bearers 4, 5, 6 can be disposed in one plane, which is provided above the uppermost end of the stack of printing plates 3.

FIG. 3 shows a state in which the uppermost printing plate 3 of the printing plate stack has been lifted off the printing plate stack in a vertical direction 15 through the use of suckers 14. In the state illustrated herein, the bearers 4, 5, 6 are then pushed under the lifted printing plate 3 in the horizontal direction 16. In this case, the printing plate 3 is only partly lifted. The rear bearer 4 is moved by the displacement, deflection or distance $W_1$ in the direction 16 under the printing plate 3, the central bearer 5 is moved by the displacement $W_2$ and the front bearer 6 by the displacement $W_3$. As described, the ratio of the displacements $W_3$:$W_2$:$W_1$ is the same as the ratio 3:2:1. A distance 21 of the front bearer 6 from the central bearer 5 is then exactly as large as a distance 22 of the central bearer 5 from the rear bearer 4, as is seen in FIG. 4.

The bearers 4, 5, 6 are then moved further under the partly lifted printing plate 3 as described, coming into contact with the underside of this partly lifted printing plate 3. For this purpose, the rods 7 of the bearers 4, 5, 6 are in each case mounted in such a way that they can rotate, which means that they can be moved under the printing plate 3 with little friction and lift the latter to such an extent that it is lifted and separated completely from the printing plate stack lying underneath.

Figure 4:
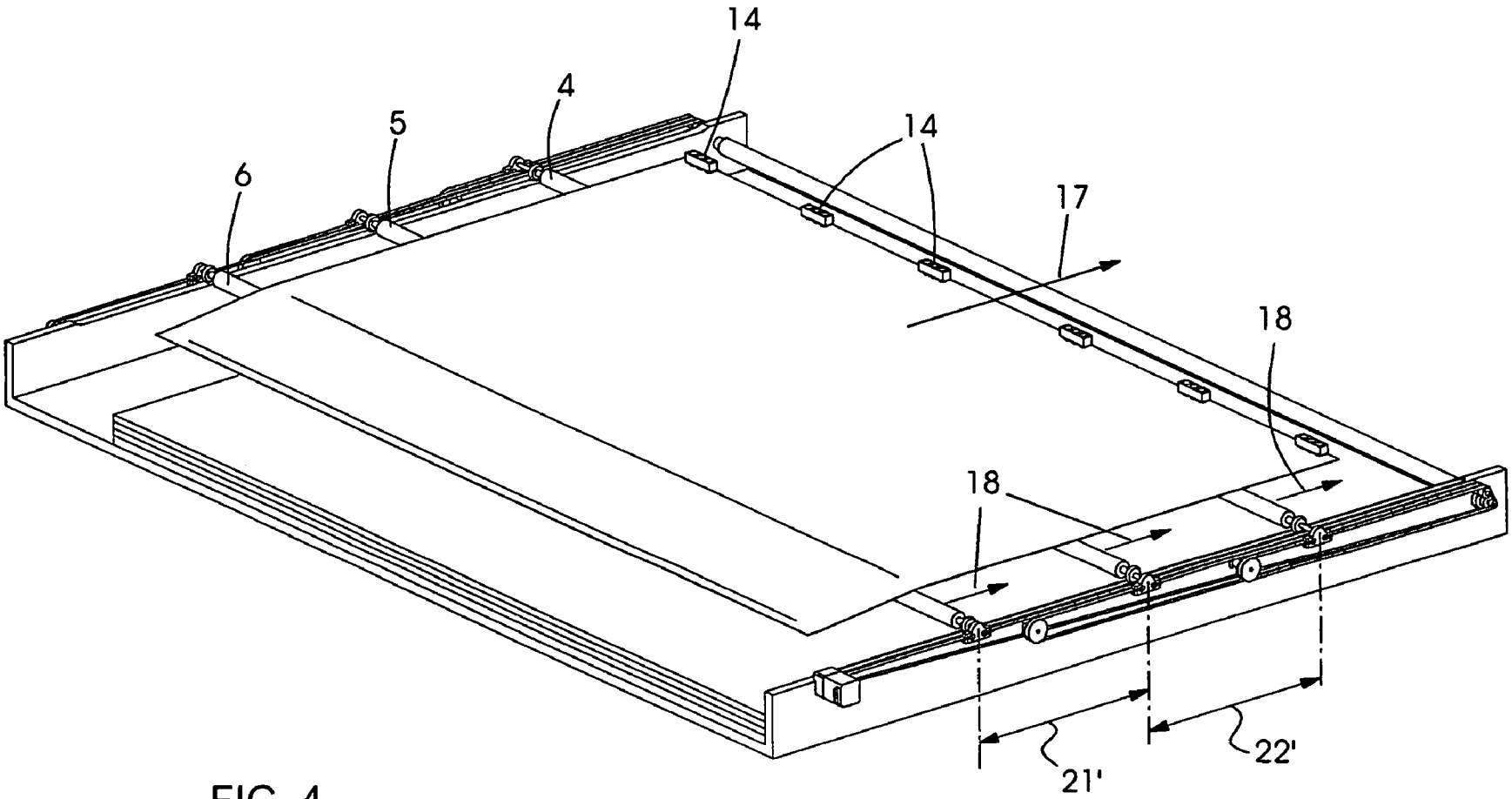
FIG. 4 is a perspective view of a printing plate lifted through the use of suckers with separating elements pushed completely underneath, ready to be transported away.

In FIG. 4, a corresponding state is shown, in which the printing plate 3 has been lifted completely off the printing plate stack lying underneath through the use of the bearers 4, 5, 6.

In order to feed the printing plate 3 to a downstream processing station for the printing plate 3, the latter is transported away from the printing plate tray 2 in a horizontal direction 17 through the use of suckers 14. In this case, the movement of the suckers 14 is followed by a movement of the bearers 4, 5, 6 in a horizontal direction 18 in each case. Even given this maximum displacement of the bearers 4, 5, 6, a now maximum distance 21' between the bearers 6 and 5 is exactly as large as a maximum distance 22' between the central bearer 5 and the rear bearer 4.

As the printing plate 3 is transported away in the horizontal direction 18, the ratio of the displacements $W_3$, $W_2$ and $W_1$ of the bearers 6, 5 and 4 in relation to one another is always constant in this case too, specifically, depending on the radii $r_3$, $r_2$, $r_1$ of the pulleys 11, 10 and 9, like the ratio 3:2:1.

Through the use of the device described herein, the distance between the three rods 7 of the bearers 4, 5, 6 is always equally large, specifically dependent on the selected gear mechanism step-down ratio 3:2:1. Therefore, in the case of a large and therefore stiff plate, a greater distance between the rods 7 of the bearers 4, 5, 6 can be achieved than is desired in the case of a smaller plate which is flexible and therefore can sag more. Given such a smaller printing plate 3, a smaller distance can thus be guaranteed by this gear mechanism step-down ratio 3:2:1. The absolute value of these distances in each case depends on the plate length being used and therefore on the maximum displacement of the individual bearers 4, 5, 6 under the printing plate 3.

Given a small printing plate 3, the bearer 6 does not travel as far as in the case of a large printing plate 3, and the rods 7 of the bearers 6, 5, 4 are therefore closer together in the case of the smaller printing plate 3. The thinner, smaller printing plate 3 therefore does not sag further than the large printing plate 3 even when the same separating device 1 is used.

Given this structure, the drive of the different bearers 4, 5, 6 can be ensured through a stationary individual motor, which has to drive only one gear linkage in order to move the pulleys 9, 10, 11. Complicated electrical connections, for example with cables, which have to be provided along with an accompanying motor, are not necessary in this case.

The invention claimed is:

1. A device for separating printing forms disposed in a stack, the device comprising:

a lifting device for lifting a printing form off the stack; and at least two separating elements each configured to be moved under the lifted printing form by respective displacements of said separating elements;

said displacements having a substantially constant ratio in relation to one another and said displacements being different from one another.

2. The device according to claim 1, wherein said at least two separating elements are at least three separating elements configured to be moved under the lifted printing form with distances between said separating elements being variable but a ratio of said distances in relation to one another always being substantially constant.

3. The device according to claim 2, wherein said ratio of said distances in relation to one another is 1:1.

4. The device according to claim 2, which further comprises:

at least one drive; and contact elements;

said separating elements being first, second and third bearers having rotatable rods connected through said contact elements to said at least one drive;

said at least one drive being configured to drive said first bearer forward by a first displacement, to drive said second bearer forward by a second displacement, and to drive said third bearer forward by a third displacement, under the printing form; and said displacements always having a predefined ratio in relation to one another.

5. The device according to claim 4, wherein said predefined ratio of said displacements in relation to one another is 3:2:1.

6. The device according to claim 4, wherein:

said contact elements are belts connecting said rods to said at least one drive;

said at least one drive has pulleys for driving said belts; and said pulleys have radii in said predefined ratio of said displacements driven forward.

7. The device according to claim 6, wherein said predefined ratio of said displacements driven forward is 1:2:3.

8. The device according to claim 2, wherein the printing forms include printing plates, and said lifting device includes suction elements gripping and vertically lifting the printing plates.

9. The device according to claim 8, further comprising:

a printing plate tray;

said suction elements are configured to keep a lifted printing plate lifted and to move it vertically;

said separating elements have running wheels, said printing plate tray having grooves for said running wheels;

said separating elements, together with the lifted printing plate under which they have been moved, are configured to be moved in a horizontal direction and run without contact over printing plates lying underneath, in said grooves for said running wheels; and said separating elements are disposed at mutual distances becoming smaller but said ratio of said distances remaining constant.

10. A method for separating printing forms disposed in a stack, the method comprising the following steps:

lifting a printing form;

moving at least first and second separating elements under the lifted printing form, by moving the first separating element through a first displacement and moving the second separating element through a second displacement; and providing the displacements in a substantially constant ratio relative to one another and the first displacement being different than the second displacement.

11. The method according to claim 10, which further comprises moving each of the separating elements underneath the printing form through a predefined maximum displacement, depending on a format of the printing form.

12. The method according to claim 11, which further comprises:

moving the printing form in a horizontal direction;

moving the separating elements in the horizontal direction, at least in order to assist the movement of the printing form; and carrying out the movement of the separating elements by rods of the separating elements without contact above printing forms located under the lifted printing form.

13. The method according to claim 10, which further comprises driving the separating elements by a drive mechanism having a predefined step-up ratio.

14. The method according to claim 13, wherein the predefined step-up ratio is 1:2:3.

15. A method for separating printing forms disposed in a stack, the method comprising the following steps:

lifting a printing form;

moving at least first and second separating elements under the lifted printing form, by moving the first separating element through a first displacement and moving the second separating element through a second displacement; and providing the displacements in a substantially constant ratio relative to one another;

providing a third separating element, moving the first, second and third separating elements under the lifted printing form through three different displacements, and providing the displacements in a ratio of 1:2:3 relative to each other.

* * * * *